United States Patent [19]

Sverdlin

[11] 4,262,642

[45] Apr. 21, 1981

[54] DEVICE FOR REDUCING FUEL CONSUMPTION IN INTERNAL COMBUSTION ENGINES

[76] Inventor: Anatoly Sverdlin, 2018 Willow Wisp, Seabrook, Tex. 77586

[21] Appl. No.: 15,592

[22] Filed: Feb. 27, 1979

Related U.S. Application Data

[63] Continuation-in-part of Ser. No. 852,091, Nov. 16, 1977, abandoned.

[51] Int. Cl.[3] ..... F02B 1/04

[52] U.S. Cl. ..... 123/378; 123/385

[58] Field of Search ..... 123/97 R, 103 R, 140 R, 123/140 FG, 140 FP, 378, 384, 385; 60/906

[56] References Cited

U.S. PATENT DOCUMENTS

| | | | |
|---|---|---|---|
| 2,640,312 | 6/1953 | Miller | 123/140 FG |
| 2,867,199 | 1/1959 | Holbrook | 123/140 FG |
| 3,978,837 | 9/1976 | Lundberg | 123/103 R |
| 4,050,434 | 9/1977 | Zbikowski et al. | 123/140 FG |

*Primary Examiner*—Craig R. Feinberg

*Attorney, Agent, or Firm*—Arnold, White & Durkee

[57] ABSTRACT

An internal combustion engine is provided with a device for automatically preventing thermal and mechanical stress during overload periods, and to power the engine with the most economical fuel consumption rate possible. In a preferred embodiment, the device is associated with the variable speed governor of the main diesel engine of a ship. The device includes a system actuated by significant movements of the governor to regulate the fuel pump or pumps or reduce the engine speed to a more economical and safe level. Means for overriding the system in emergency situations may be provided.

15 Claims, 6 Drawing Figures

DEVICE FOR REDUCING FUEL CONSUMPTION IN INTERNAL COMBUSTION ENGINES

CROSS-REFERENCE TO RELATED APPLICATION

This application is a continuation-in-part of Ser. No. 852,091, filed Nov. 16, 1977 now abandoned.

BACKGROUND OF THE INVENTION

1. Field of the Invention

The invention relates to devices for preventing thermal and mechanical stresses in internal combustion engines. In particular, this invention relates to an automatic control device associated with the governor of an internal combustion engine for regulating the fuel pumps during engine overload conditions.

2. Description of the Prior Art

The main diesel engine of all ships that have direct rotation from the engine to constant pitch propellers perform according to the propeller characteristics. Propeller characteristics depend upon effective parameters of working conditions derived to the propeller, or propeller torque, and other parameters of working conditions derived from the number of revolutions of the diesel engine when it is working to the propeller. Working conditions vary according to the ambient conditions at any given time—wind, sea conditions, keel draugh, towing or load, physical condition of the propeller and ship's hull, depth of water, etc.

In the operation of diesel engines with constant pitch propellers, the two most important speed considerations are those under full speed, and those under loaded or towing conditions. Full speed is necessarily variable to accommodate a wide range of loaded conditions, and the power requirements vary accordingly.

When a ship enters shallow waters, the resistance by the ship's hull increases, and the power expenditure required to overcome the wave action and water resistance increases. With an increase in power requirement, there is a resultant increase in combustion pressure, exhaust gas temperature, and mean indicator pressure. Exceeding the manufacturer's limits of these characteristics causes the engine to undergo both thermal and mechanical stress. At the same time, considerable increase in fuel consumption is required with a decrease in forward speed. To overcome the stress situation, it has been necessary to decrease the fuel supply manually from the control room or the bridge.

Under towing or loaded condition, which are the principal heavy working requirements of the engine, the operator determines the optimum control necessary to prevent the placing of stress on the engine. This is accomplished by constant observance of exhaust gas temperature or power indicator gauges. Due to continuing changes in ambient conditions encountered by the ship, the control room operator may choose to delay taking corrective action, since conditions may reverse at any time. However, engine operation under overload conditions for a period of 10 to 20 minutes can result in additional fuel consumption of 25%–35% for that period with no increase in speed of travel. Moreover, extensive damage to the engine may result from stress.

The majority of diesel engines are equipped with variable speed governors which control the operating speed of the engine. By the addition of a control device to the variable speed governor, it is possible to automatically protect the engine from thermal and mechanical stress. By automatically preventing the engine from overloading, it is feasible to realize a savings of 25 to 35% in fuel consumption during overload periods. Further, a saving is also realized in prolonging the normal engine life. The entire concept of an automatic control device is to keep the engine performance within the limits of the manufacturer's operating specifications under all load conditions whether constant or varying.

An automatic control preferably should be designed for bypass by the operator during any period of emergency for the ship where engine stress would not be a consideration.

Prior attempts to protect against stresses on marine diesel engines have generally fallen into three categories. A first method is a manual control method whereby the exhaust gas temperature is continuously monitored as an indication of the load on the engine. When the exhaust temperature goes above a particular maximum for a given engine, e.g., 375° C., the control room operator manually takes corrective action by reducing fuel input to the engine. This method has an inherent limitation in that the exhaust temperature must be constantly monitored and the corrective action must be taken according to subjective determinations made by the operator.

A second method utilizes a so-called position feedback system including thermistors which measure the engine exhaust temperature. The signals from the thermistors, after amplification, are utilized to control the governor thereby reducing fuel consumption and engine speed. A primary disadvantage of this method is that it reduces fuel consumption only in response to increased temperature; therefore, it is cyclic in nature so that the engine must be continuously heating up and cooling down in order for the system to work. Such systems have been provided with memory elements to smooth out the cyclic nature of operation, but they have proved extremely costly and ineffective in operation.

A third approach has been a system utilizing ultrasonic sounders to continuously monitor the depth of the water in which the ship is operating. The depth signal is utilized to program the governor. Obviously this "self-governor" method is limited to ship applications and is operable to sense only overload conditions caused by shallow waters. Furthermore, the art has yet to provide ultrasonic sounders which are accurate in shallow waters due to the interference from air bubbles which are found in shallow water.

In addition to the need for an automatic means for correcting for the loading conditions on a marine engine, it is equally important that the fuel economy of the engine be maintained at its most economical setting and to maintain as constant a ship speed as possible. That is, an engine that is experiencing heavy loading conditions and the ship's speed is reduced, the power consumption will go up without an increase in the speed. This added power input is reflected as increased heat in the engine, and is a direct result of an increase in the fuel input. It is a characteristic of ships that approximately the same ship speed, resulting from loading conditions, can be maintained at a reduced fuel consumption rate and at a lower engine speed. This reduced fuel consumption can be substantial, approaching 25 to 35% fuel savings.

Under loading conditions, an engine that attempts to work harder to maintain its normal engine speed setting, merely tends to increase the loading thereon. For example, a ship which is in shallow water and experiencing a travel speed reduction due to greater drag, may attempt to increase the fuel input to the engine to regain the lost travel speed. Unfortunately, the harder the engine tries to push the ship through the water, the greater the drag or resistance exerted by the water on the ship. As a result, the loading increases and causes a further decrease in the travel speed.

Thus, the present state of the art shows that there is an acute need for a reliable and simple automatic device to protect against thermal and mechanical stress on internal combustion engines, especially marine diesel engines, and to operate the engines under loading conditions at the most economical fuel consumption rate possible.

SUMMARY OF THE INVENTION

According to the apparatus of the present invention an internal combustion engine, for example a marine diesel engine, is protected against thermal and mechanical stress resulting from towing or loaded conditions by a control device actuated by movements in the engine governor. In the preferred embodiment, the control system includes a cam mounted on the movable linkage of the relay-type governor. In response to selected movements in the linkage, the cam engages its cam follower to actuate the control system. The cam follower serves to open a sensor valve in a pneumatic system. Through a series of valves and conduits, a servomotor, operating as speed control member in the movable linkage, operates through a relay-type governor to the fuel pump to vary the fuel input to the engine. At the completion of a scanning cycle of predetermined duration, the servomotor is deactivated to permit the engine to resume full power conditions. If the loadings on the engine are still present, the control device is once again activated and a scan cycle begun to reduce the power input to the engine.

DESCRIPTION OF THE PREFERRED EMBODIMENT

Figure 5:
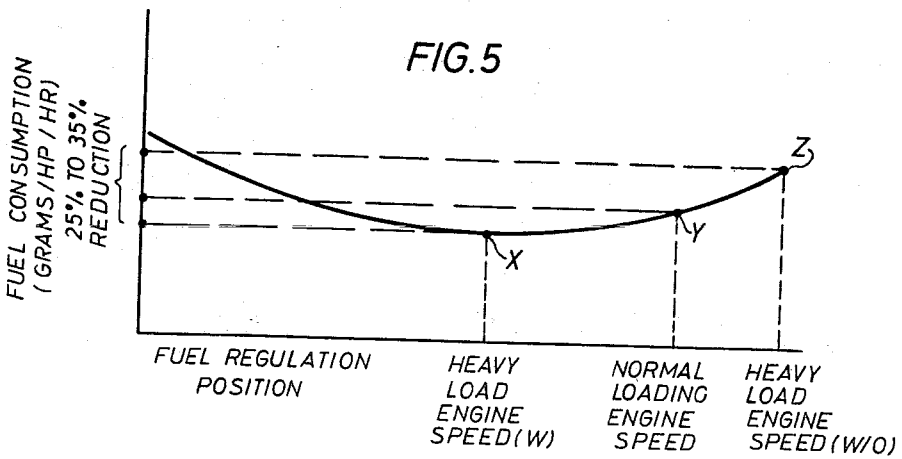
FIG. 5 is a curve of fuel consumption versus fuel regulation signal for a typical marine diesel engine.

Referring to the drawings and first to FIG. 5, a curve of fuel consumption versus fuel regulation signal for a typical diesel engine used in marine applications is shown. Under normal loading conditions (point Y), the engine speed is selected and regulated to propel the ship through the water at a desired ship speed. However, when heavy loading conditions are encountered and the ship's speed decreases, the engine speed regulator attempts to increase the fuel input to the engine expecting the engine and the ship to come back to their normal operating speeds. Because of the loading, they don't. This causes an even greater increase in the fuel input (point 7). Eventually, the input power level to the engine reaches a point at which the engine begins to experience excessive stress and temperature, and the ships speed continues to slow down, even with greater amounts of fuel to the engine.

At this point, the present invention, as is described more fully below, purposefully reduces the fuel signal to the fuel pumps to reduce the fuel consumption and the speed setting of the engine. This is reflected as a shift in the operating point of the engine marked as point X of FIG. 5. Point X is chosen to be the most economical speed for fuel consumption rate for the engine. By reducing the speed of the engine, the ship does not work as hard trying to go forward and may result in an actual increase in ship speed over that speed achieved while operating at the engine speed of point Y but under heavy loading conditions.

Figure 1:
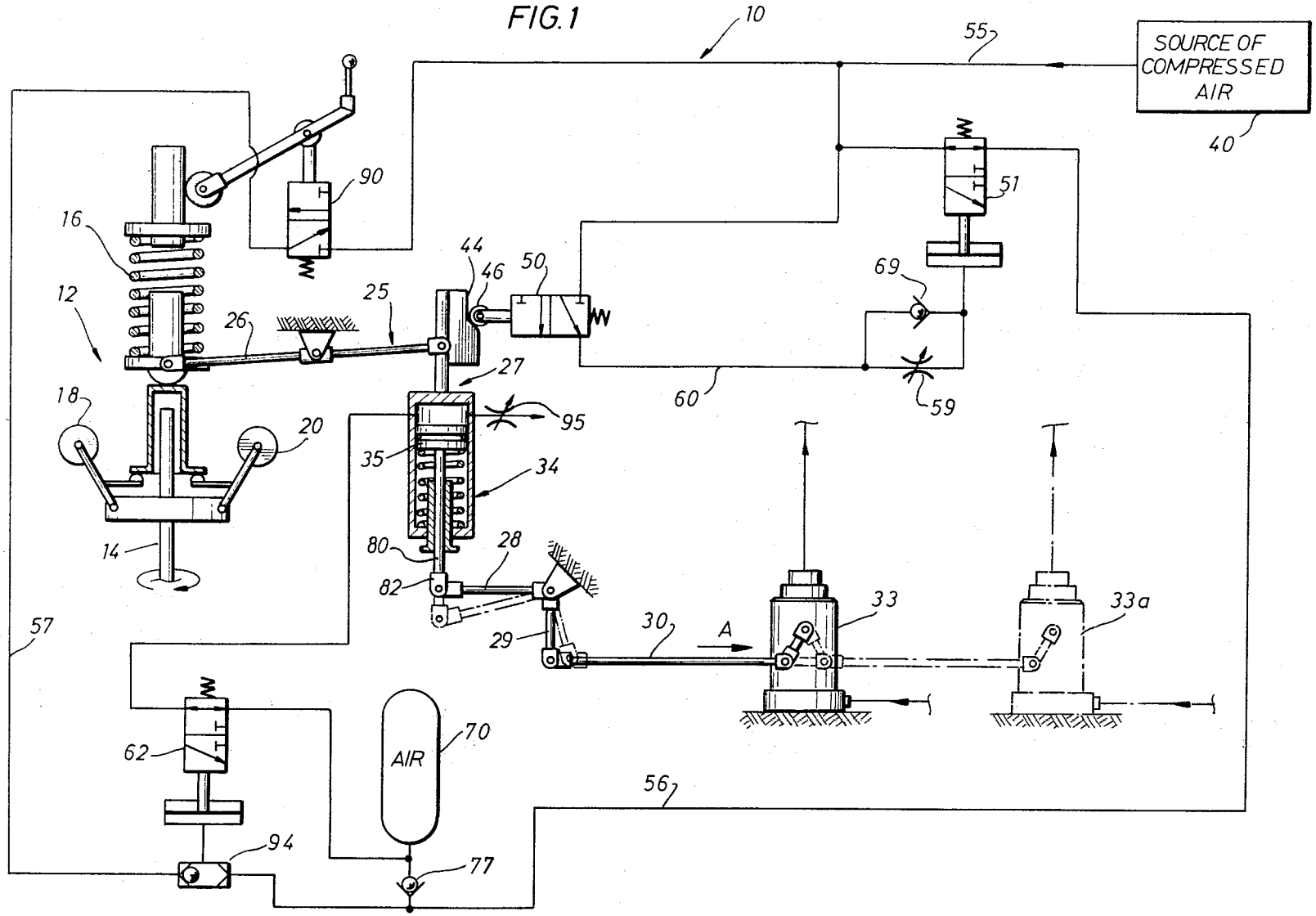
FIG. 1 schematically illustrates an embodiment of the device of the present invention as it is operatively associated with a direct action variable speed governor.

Referring now to FIG. 1, the control device 10 is shown in operative association with a direct action variable speed governor 12. Governor 12 includes a central shaft 14 connected to the engine drive shaft, a speeder spring 16 and a pair of flyweights 18, 20. Linear movement of spring 16 in response to variations in the centrifugal force generated by flyweights 18, 20 serves to shift the linkage 25. Linkage 25 includes links 26, 27, 28, 29 and 30. In a conventional embodiment of the governor, link 27 is a solid rod or shaft connecting links 26 and 28. In accordance with the present invention, the rod is replaced by a link including a pneumatic servomotor mechanism 34 having a piston 35. Servomotor 34 functions as an movable extensible member to permit the length of the link connecting links 26 and 28 to be varied; it serves to drive link or fuel rack 30 which is in operative association with the controller of a fuel pump 33 to vary the fuel input to the associated cylinder, and to serve as a dampening mechanism for absorbing shock from abrupt movement in the linkage 25.

The above-described flyweights, speeder spring and linkage are that associated with a direct action variable speed governor commonly used with marine diesel engines. While not illustrated, those skilled in the art will appreciate that the present invention may be associated in the same manner with a relay-type drive governor.

The control device 10 of the present invention is operative in response to movement of linkage 25 and serves to limit the output of fuel pump 33 during engine overload conditions. System 10 includes a source of compressed air 40. In the preferred embodiment a 15 p.s.i.g. pneumatic system is used for a relatively small engine. The system may use higher pressures, for example 125 p.s.i.g. As described below, the source of pressurized air is routed through a series of conduits and three-way pneumatic valves to selectively drive servomotor 34 which engages links 27–30 to limit the fuel during overload conditions.

During normal operation of the engine, for example under full engine speed with 100% loading conditions in deep water, governor 12 and linkage 25 assume the normal position illustrated in solid lines in FIG. 1 whereby the fuel pump maintains a relatively constant fuel input to maintain the constant drive shaft speed. Slight variations in load conditions will result in the governor varying the fuel input in the manner known in the art. During normal operation, the control device 10 is inoperative in the sense that it does not affect the fuel input dictated by the fuel pump 33. Stated differently, during this normal-load operation the servomotor 34 serves as a floating component or shock absorber but is not actuated for a fuel pump control purpose.

In response to a substantial decrease in engine speed representing the beginning of overload operation, a cam 44 mounted on output linkage 27 of the governor 12 is displaced upwardly to move an associated cam follower 46, thereby opening a normally closed sensor valve 50. The opening of valve 50 allows pressurized air to flow through a line 60 so that it closes the normally open pilot operated master valve 51. Line 60 is provided with a needle throttle valve 59 which limits the airflow to valve 51. Throttle valve 59 is adjusted to assure that the overload condition must exist for some predetermined time, e.g., 20 seconds, before a sufficient flow of air reaches valve 51 to cause it to close. A check valve 69 prevents discharge.

The closing of valve 51 cuts off the air pressure in line 56 thereby opening the normally open pilot operated servomotor control valve 62 which had been closed. The opening of valve 62 allows a flow of pressurized air to be impressed upon servomotor 34 from an accumulator 70 which was previously charged through line 55, valve 51, and line 56. A check valve 77 prevents escape of pressurized air from the accumulator 70. Servomotor 34 when actuated displaces its drive spindle 80 outwardly. This, in turn moves links 28, 29 and fuel rack 30 in the direction of the arrow A in FIG. 1, thereby decreasing the fuel output of fuel pump 33. This actuation of servomotor 34 results in a decrease in engine speed although the governor has indicated that there is a need for an increase. An adjustable bushing 82 is provided to control the initial or "zero" position of spindle 80.

As the engine rpm is decreased by actuation of servomotor 34 in the above-described manner, the centrifugal force of governor flyweights 18 and 20 continues to decrease. Speeder spring 16, which had constant tension before the rpm was decreased, continues to lengthen and move link 26 downwardly. Cam 44 thereby continues to move up and continues to hold open normally closed valve 50 by means of cam follower 36. The additional movement of cam 44 causes the liner 36 and the piston 35 of servomotor 34 to continue to move in opposite directions. The piston 35 and its associated spindle hold down the engine speed through links 28, 29 and fuel rack 30. Speeder spring 16 in this condition has a greater force than the centrifugal force of flyweights 18 and 20.

At this time, air from accumulator 70 supplied through normally open valve 62 is constantly flowing to servomotor 34. The air supplied to servomotor 34 is vented to atmosphere through throttle valve 95. When air accumulator 70 is fully discharged through throttle valve 95, piston 35 of servomotor 34 will move up inside liner 36 by the force of its spring. As a result, fuel rack 30 through linkages 28, 29 and spindle 80 moves in the opposite direction of arrow A. That is, the fuel input to the engine is increased. As a result of this fuel increase, the resultant speed of the engine will be increased, as will the centrifugal force from flyweights 18 and 20. Speeder spring 16 of governor 12 will once again be compressed. This, in turn, moves linkage 26 in a direction to move cam 44 and servomotor 34 down. The speed of the engine does not increase more rapidly or to a speed higher than that required.

As is now apparent, servomotor 34 is the floating component of the system. Because cam 44 has now been moved down by linkage 26, valve 50 will be closed. When valve 50 closes, air from pilot operated valve 51 through check valve 69 and line 60, discharges to atmosphere. When valve 61 is once again open, accumulator 70 will again be charged from source 40 through lines 55 and 56. At the same time, valve 62 through an "or" valve 94 will be closed. If ship and engine at this time have returned to normal conditions (i.e. engine can run at 100% without causing thermal or mechanical stress), cam 44 will be under cam follower 46 of valve 50. However, if the engine still is operating under an overloaded condition, the ship's speed and the engine will not continue to increase to normal operating conditions. As a result, the governor speeder spring 16 will once again move down and cam 44 will again open valve 50 and the speed reducing process repeated.

Thus, the system works on a scanning cycle and uses the existing governor of the engine as a sensor to compute overload conditions of the engine. The duration of each scanning cycle may be adjusted according to the ship's propeller characteristics. Normally, the scan cycle rate is 15–30 minutes. This scan rate can be adjusted by the volume of the air in accumulator 70 and/or regulating throttle valve 95.

The control device 10 may be used to control a plurality of fuel pumps corresponding to a selected number of cylinders. In this regard, fuel rack 30 may be continued to control a plurality of on-line fuel pumps, one additional pump being shown in FIG. 1 as fuel pump 33*a*. The plurality of fuel pumps controlled by device 10 may be arranged in any of a number of known configurations, for example, radial block or injector unit designs. Regardless of the arrangement of fuel pumps, the pumps may be controlled by selected movements of the single fuel rack.

Control device 10 is provided with an override shutdown 90 which may be opened manually on the bridge of the ship. Opening of valve 90 allows pressurized air to flow through line 57 and "or" valve 94 to close valve 62, thereby overriding the control device 10. Shutdown valve 90 is provided for use in emergency situations where engine stress is not of primary importance.

Figure 2:
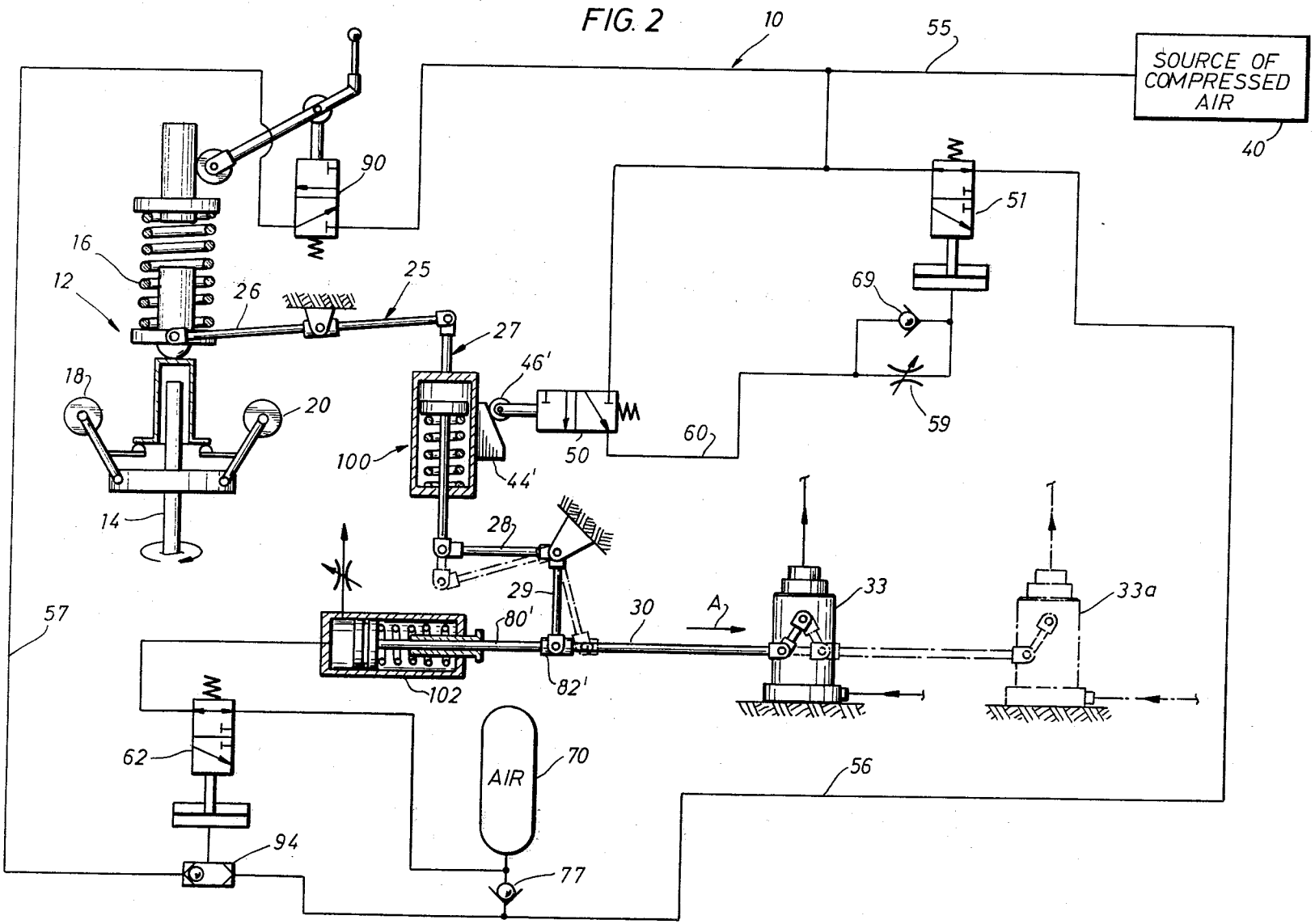
FIG. 2 illustrates a first alternative embodiment to that illustrated in FIG. 1.

Referring now to FIG. 2, an alternative embodiment for use with a governor of the type having a dampener or shock absorber 100 already provided as an integral part of link 27 is shown. In the embodiment of FIG. 2, cam 44' is attached directly to the wall surface of shock absorber 100 and is positioned in operative association with a cam follower 46'. In this embodiment a servomotor 102 has its spindle 80' and adjustment bushing 82' on line with and directly connected to fuel rack 30. This embodiment works the same as the previously described embodiment except that the dampening function and fuel pump control function are provided by different components, shock absorber 100 and servomotor 102 respectively.

Figure 3:
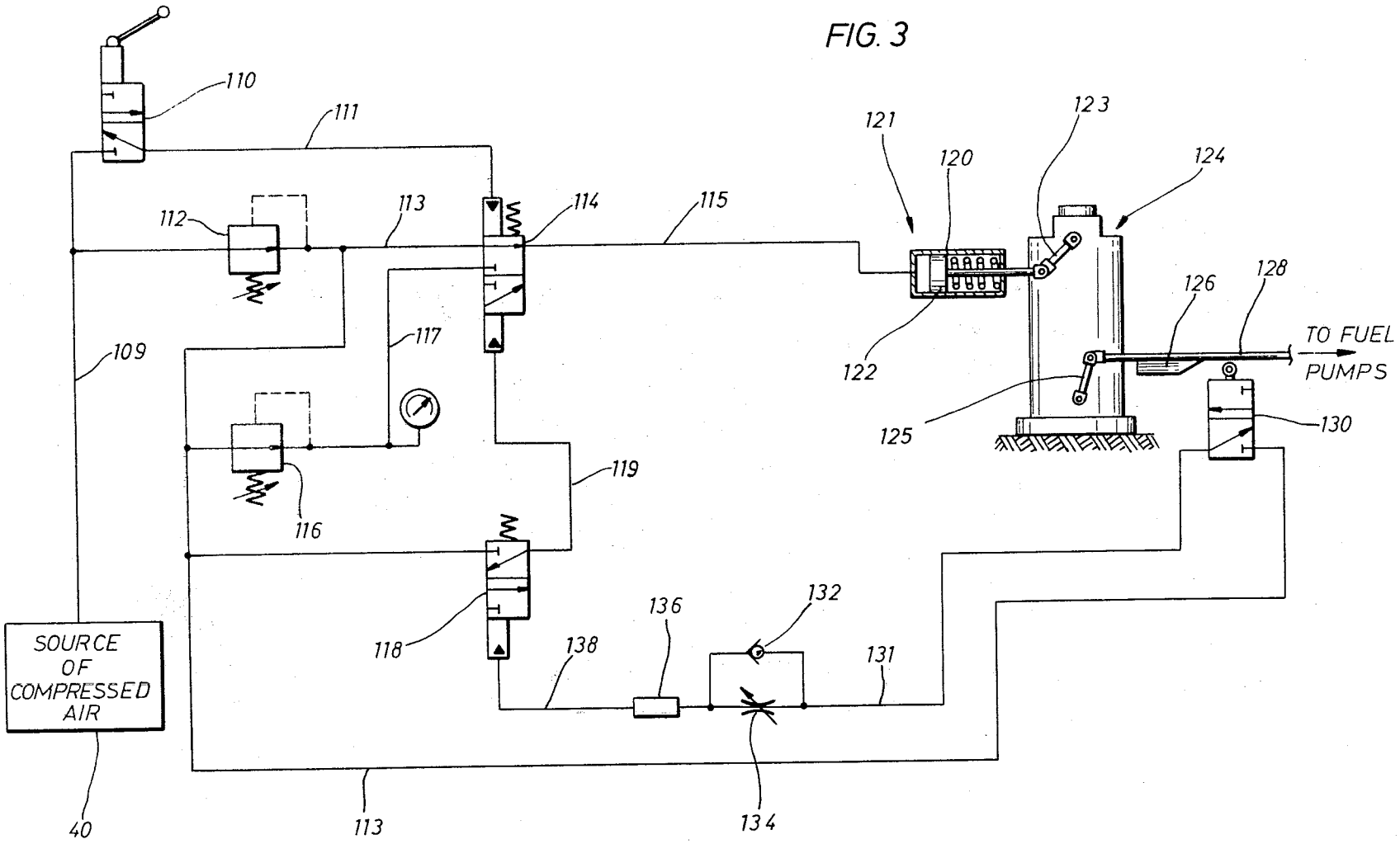
FIG. 3 illustrates the preferred embodiment of the present invention for use with a relay-type governor.

Turning now to FIG. 3, the preferred embodiment of the present invention is shown. The embodiment of FIG. 3 is shown with a governor known in the art as a relay-type governor. As shown in FIG. 3, a source of compressed air 40 supplies pressurized air in line 109 to pressure regulator 112 and master override switch 110. Master override switch 110 functions to override the control of directional control valve 114 to always select the speed setting to governor 124 according to the pressure from pressure regulator valve 112. In its normal operating position, override valve 110 does not supply pressure from line 109 to line 111. Pressure regulator 112 regulates the input air supply in line 109 and applies the regulated air pressure to service line 113. Service line 113 services directional control valve 114, pressure regulator 116, time delay valve 118 and stress sense valve 130.

The output from pressure regulator 116 is regulated to a value less than the air pressure in input supply line 113. The output of pressure regulator 116 is supplied via air line 117 to control valve 114. Control valve 114 will be controlled to select either the pressure from pressure regulator 112 or the air from pressure regulator 116. In other words, control valve 114 will select either the air control pressure for the desired speed selected for normal loading conditions or it will select a smaller pressure corresponding to a reduced engine speed.

The output from control valve 114 is supplied via supply line 115 to an air pressure actuated piston 121. The pressure supplied to piston 121 actuates the push rod 122 that is affixed at its spindle end to the input speed select lever 123 of the relay-type governor 124. In other words, the air pressure to piston 121 causes the piston to move in a direction to rotate the engine speed selecting lever of governor 124. Thus, by selecting the appropriate air pressure in supply line 113, the various normal loading condition speeds for governor 124 may be selected. In its normal load condition, the air pressure in supply line 113 is selected and applied to line 115 by control valve 114. Small variations in the engine speed, as sensed by governor 124, controls the fuel supply to the engine to maintain the desired engine speed.

However, if the engine goes into an overload condition in which the speed of the engine is slightly reduced, governor 124 will cause the output lever 125 to attempt to increase the fuel input to the engine over 100% of the load. That is, output lever 125 of governor 124 rotates in a direction to move the linkage 128 and attached cam 126 towards the cam follower of stress sense valve 130. When cam 126 depresses the stress sense valve 130 cam follower, valve 130 is actuated to permit the air pressure in line 113 to appear in supply line 131. The pressure in air line 131 is allowed to pass through a needle throttle valve 134 and into an air volume 136. The output of air volume 136 is applied to time delay valve 118 through air line 138. Time delay valve 118 may be such as that manufactured by Agastat as model PT 41H. OFF Delay.

If the actuation of stress sense valve 130 by cam 126 was only momentary or of short duration, there will not be a sufficient amount of time for a sufficient amount of air to pass through needle throttle valve 134 and air volume 136 to actuate the time delay control valve 118. In other words, the combination of check valve 132, needle throttle valve 134 and air volume 136 is to filter out momentary speed variations in the engine. When a true overload condition is present, time delay control valve 118 will eventually be actuated. For this condition, the pressurized air in line 113 will be supplied through time delay control valve 118 to control valve 114 via air line 119.

Time delay valve 118, once the actuating pressure in line 138 has been removed, will remain actuated for a predetermined time interval before it operates to open the connection between supply line 113 and air line 119. When time delay control valve 118 actuates, control valve 114 will be switched so that the lesser air pressure supplied to air line 115 comes from the pressure regulator 116 through line 117. With a reduced air pressure in line 115, piston 121 causes the input speed select lever 123 to be moved in a direction to decrease the speed of setting of the governor 124. Consequently, the output lever 125 rotates to remove the cam 126 from actuating stress sense valve 130. This in turn, causes the stress sense valve 130 to close and remove the pressure to time delay control valve 118. Thus, an incremental step decrease in engine speed results. A decreased fuel consumption rate occurs with a decrease in engine speed.

This decreased and more economical fuel consuption rate continues for as long as time delay valve 118 is actuated. At the completion of the delay time of delay valve 118, the control pressure in line 119 is removed and control valve 114 returns to its normal position. Immediately, an increased air pressure in line 115 causes the governor speed select setting to once again be placed at the normal loading operating position. If the engine is able to produce the desired power for 100% load, then the cam 126 will not actuate stress sense valve 130, and the system will return to its normal operating conditions. However, if once again the engine is in the overload condition, governor 124 will attempt to continually increase the fuel supplied by the pumps until cam 126 once again actuates stress sense valve 130. This beginning the next scan cycle as discussed above.

The system works on a scanning cycle and uses the existing governor of the engine as a sensor to compute overload conditions of the engine. The duration of each scanning cycle may be adjsuted according to the ship's propeller characteristics. Normally, the scan cycle rate is 15–30 minutes. This scan rate can be adjusted by time delay valve 118. (OFF DELAY).

Figure 4A:
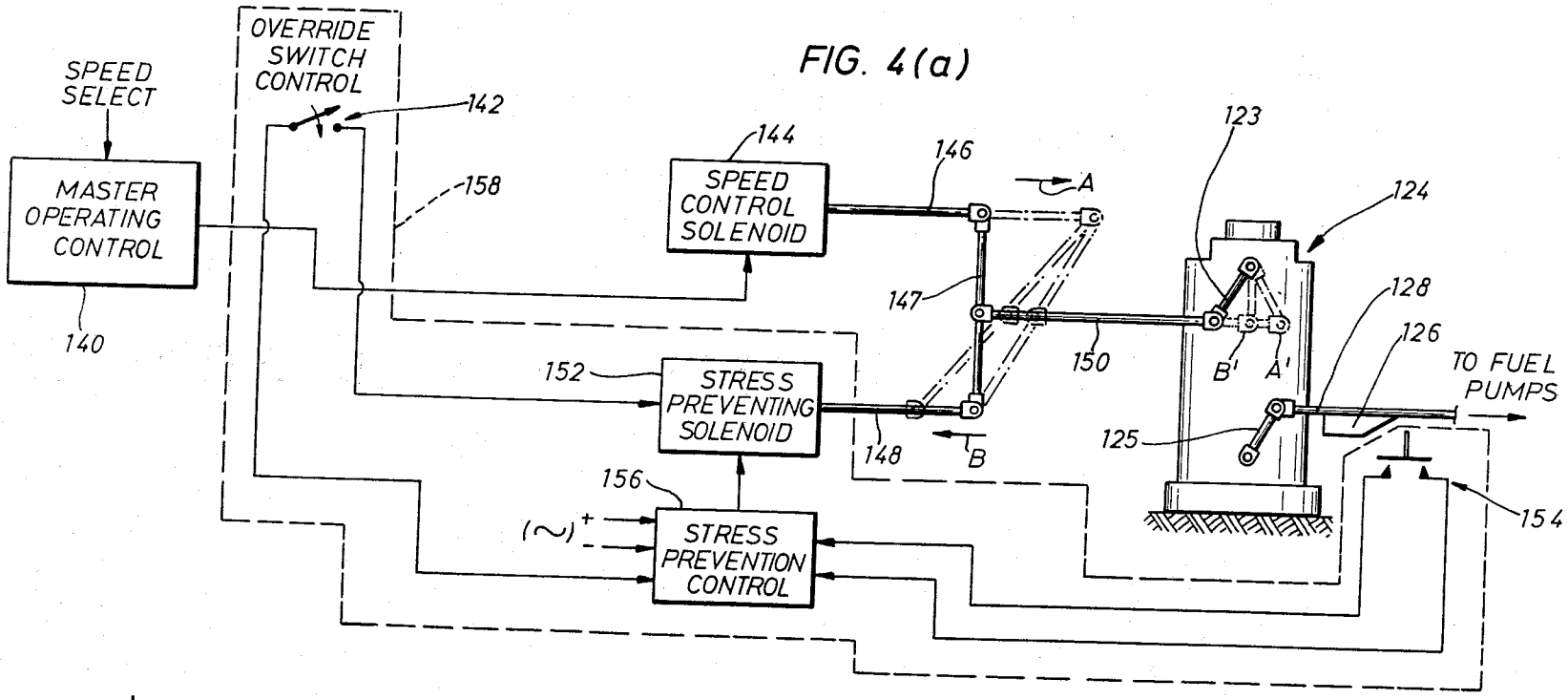
FIGS. 4(*a*) and 4(*b*) illustrate an electrically actuated embodiment to that illustrated in FIGS. 1–3.
Figure 4B:
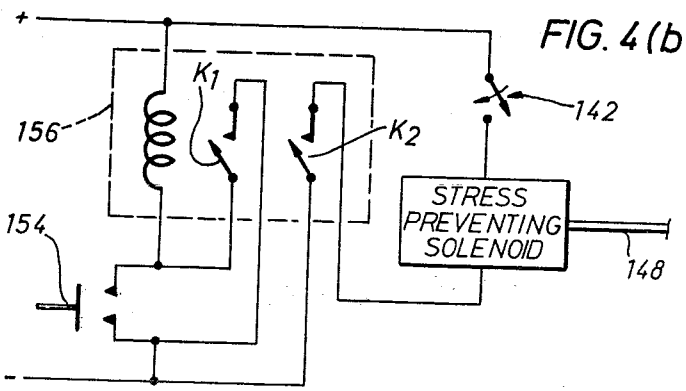

Turning now to FIG. 4(*a*) and (*b*), yet still another embodiment of the control device is shown. The embodiment as shown in FIG. 4 comprises an electrical approach utilizing the relay-type speed governor 124 as illustrated in FIG. 3. For this embodiment, a speed control solenoid 144, having a plunger linkage 146, is connected to the plunger linkage 148 of a stress preventing solenoid 152 via linkage 147. The speed control solenoid 144 and the stress preventive solenoid 152 operate to control the input speed selection lever 123 of governor 124 by way of linkage 150 which is connected to the linkage 147. The speed control solenoid 144, when activated, moves plunger linkage 146 in the direction of arrow A as shown in FIG. 4(*a*). The stress preventing solenoid 152, when activated, moves the plunger linkage 148 in the direction of arrow B, also shown in FIG. 4(*a*). As shown, the direction illustrated by arrow A is opposite to that of arrow B. When the speed control solenoid 144 and the stress preventing solenoid 152 are in their unactivated states, the linkages 146, 147, 148 and 150 assume the positions as shown by the solid lines in FIG. 4(*a*).

The control device as illustrated in FIG. 4(*a*) and (*b*) operates as follows: A master operating control 140, responsive to speed select signals from the bridge, actuates controls the speed control solenoid 144 to move the plunger linkage 146 forward to the position as shown by the dotted lines. This movement of plunger linkage 146 moves the input control lever 123 of governor 124 to the position labelled A′ as shown in FIG. 4(*a*). In this position, the output lever 125 of the governor 124 controls the fuel pumps via output linkage 128 attached to the output lever 125 to select the normal loading condition operating speed. At this position of lever 125, cam 126, which is attached to the output linkage 128, is not contacting cam follower of stress limit switch 154.

Under normal load conditions, the governor 124 continues to function in this normal manner to control the fuel pumps to the engine for minor speed variations to maintain the preselected speed corresponding position A'. However, when the engine goes under loaded conditions and the engine speed decrease significantly, the output lever 125 of governor 124 rotates in a direction to move the cam 126 against the cam follower of the stress limit switch 154. At the stress limit selected, stress limit switch 154 closes to generate a start scan signal to activate the stress prevention control 156. The output of stress prevention control 156 controls the actuation of the stress preventing solenoid 152. When activated, stress preventing solenoid 152 causes the plunger linkage 148 to move in the direction as illustrated by arrow B. This causes linkage 150 to move the input lever speed select lever 123 of governor 124 to the position marked B'. This in effect, reduces the speed setting of the governor 124 and causes the output lever 125 to rotate in a direction to move cam 126 away from the stress limit switch 154 cam follower. This allows the switch 154 to open.

Referring now to FIG. 4(*b*), a circuit diagram of the stress prevention control 156 as connected to the stress limit switch 154 and the stress preventing solenoid 152 is illustrated. As just described, when the cam 126 moves forward to a position to close the stress limit switch 154, a circuit between the power supply rails through the coil of a time delay relay R is completed. This permits the relay R to actuate. Actuation of relay R closes contacts $K_1$ and $K_2$. The relay contact $K_1$ is connected in parallel to the stress limit switch 154 contacts to provide an alternate circuit path to energize the coil of time delay relay R. The contacts $K_2$ of relay R complete the circuit between the power supply rails to activate the stress preventing solenoid 152 if the override switch control 142 has been closed. Override switch control 142 functions to manually override the automatic control system when overload conditions are not important. When stress preventing solenoid 152 actuates, the speed setting to governor 124 is reduced and thereby causes the cam 126 to move off of the cam follower of stress limit 154. This in effect removes one of the circuit paths for activation of the time delay relay R. However, because the contacts $K_1$ has provided an alternate path, the time delay relay R continues to be activated. This condition will remain until the time delay setting for the relay has occurred. In other words, the stress preventing solenoid 152 will remain activated for as long as the delay setting of the time delay relay R.

At the completion of the time delay setting, relay R drops out and removes the circuit path to activate stress preventing solenoid 152, and permits the plunger linkage 148 to move forward to its actuated positon. This returns the input speed selection to governor 124 to the position marked A'. If the load conditions are still present, the engine speed will not be able to achieve the normal loading speed setting and cam 126 will once again close stress limit switch 154. Thus, a second scan cycle for the control device will begin. If on the other hand, the load condition is no longer present, the engine speed will be able to come up to the desired speed without cam 126 actuating the stress limit switch 154.

For the electrical embodiment of the present invention just described, only one stress preventing solenoid and speed control solenoid has been shown and discussed. However, it is obvious to a person of ordinary skill in the art that more than one solenoid may be utilized to achieve incremental changes in engine speed in the same manner as described when only one solenoid is used.

Although each embodiment shown and described herein uses an engine governor to sense the loaded condition of the engine, it is obvious to a person of ordinary skill that other means for sensing the loading condition of the engine are possible. For example, sensing the engine exhaust gas temperature, sensing the water depth, sensing the water pressure against the ships hull, etc.

Many variations not illustrated in the drawings may come within the scope of the invention. For example, instead of cmpressed air other sources of pressurized fluids may be used in the control device.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features. All as would be apparent to one skilled in the art after having the benefit of this description of the invention.

What is claimed is:

1. In an automatic control system for regulating the speed of an internal combustion engine, the system having, (a) an engine speed selector, for selecting a normal loading condition speed for the engine, (b) a governor, for sensing the engine speed relative to the selected speed, and (c) a fuel supply means responsive to the governor for supplying fuel to the engine, the improvement comprising:

(1) an engine load sensing means connected to said fuel supply means and responsive to the rate of fuel supply, for sensing when the engine is under heavy loading conditions, said load sensing means generating a start scan signal when heavy loading conditions are present on the engine;

(2) a time interval generator responsive to the start scan signal, for generating a predetermined scan interval time during which the normal loading condition speed in reduced to a lower regulated engine speed, the scan interval time having a time interval sufficient to permit the engine speed to attain the lower regulated entine speed; and (3) an engine speed control means responsive to said engine speed selector and said time interval generator, for generating a fuel control signal to said fuel supply means to (i) maintain the normal loading condition engine speed when normal loading conditions are present on the engine, and to (ii) reduce the rate of fuel supply to the engine during each generated scan interval time to obtain the lower regulated engine speed thereby reducing the stress and fuel consumption of the engine when heavy loading conditions are present on the engine while maintaining a desirable speed of travel, the total time interval from all of the generated scan time intervals permitting the engine to run at the lower regulated engine speed until the heavy loading conditions are no longer present on the engine.

2. An automatic control device for regulating the engine speed of a marine diesel engine during periods of heavy loading conditions, said control device controlling the engine speed to a lower regulated engine speed than a normal regulated engine speed while maintaining the speed of travel during periods of heavy loading conditions thereby reducing fuel consumption and stress to the engine, the device generating a fuel control signal to control the engine speed, the device comprising:

(a) a fuel supply means responsive to the fuel control signal, for supplying fuel to the engine, said fuel supply means indicating the rate of fuel supply to the engine;

(b) an engine load sensing means connected to said fuel supply means and responsive to the rate of fuel supply, for sensing when the engine is under heavy loading conditions, said load sensing means generating a start scan signal when heavy loading conditions are present on the engine;

(c) a time interval generator responsive to the start scan signal, for generating a predetermined scan interval time during which the normal regulated engine speed is reduced to the lower regulated engine speed, the scan interval time having a time interval sufficient to permit the engine speed to attain the lower regulated engine speed;

(d) an engine speed selector, for selecting the normal regulated engine speed for normal loading conditions; and (e) an engine speed controller responsive to said engine speed selector and said time interval generator, for generating the fuel control signal to said fuel supply means to (i) maintain the normal regulated engine speed when normal laoding conditions are present on the engine, and to (ii) reduce the rate of fuel supply to the engine during each generated scan interval time to obtain the lower regulated engine speed thereby reducing the stress and fuel consumption of the engine when heavy loading conditions are present on the engine while maintaining the speed of travel, the total time interval from all of the generated scan time intervals permitting the engine to run at the lower regulated engine speed until the heavy loading conditions are no longer present on the engine.

3. The device according to claim 2 wherein the time interval generator is a time delay relay.

4. The device according to claim 3 wherein the load sensing means comprises:

(a) a cam actuated stress limit switch, for generating a start scan signal when the fuel supply means has reached a predetermined rate of fuel supply; and (b) a cam operatively associated with the fuel control signal, for actuating said stress limit switch.

5. The device according to claim 4 wherein the engine speed controller comprises:

(a) a relay-type speed governor having an input speed selector lever, said governor responsive to the engine speed;

(b) a speed control solenoid responsive to said speed selector, for moving the input speed selector lever to a first position corresponding to the speed selected for normal loading conditions;

(c) at least one stress preventing solenoid responsive to the time delay relay, for moving the input speed selector lever to a second position corresponding to an engine speed selection less than the speed selected for normal loading conditions, said second position corresponsing to the lower regulated engine speed; and (d) a set of linkages operatively associated with said solenoids and said input speed selector lever, for transferring said solenoid actuation signals to said governor.

6. The device according to claim 2 wherein the time interval generator is a time delay valve.

7. The device according to claim 6 wherein the load sensing means comprises:

(a) a cam actuated stress limit valve, for generating a start scan signal when the fuel supply means has reached a predetermined rate of supply; and (b) a cam operatively associated with the fuel control signal, for actuating said stress limit valve.

8. The device according to claim 7 wherein the engine speed selector comprises:

(a) a first air pressure regulator, for supplying a first pressurized air to said speed controller, said first pressure corresponding to a selected engine speed for normal loading conditions on the engine; and (b) a second air pressure regulator, for supplying a second pressurized air to said speed controller, said second pressure corresponding to a reduced engine speed from the speed selected by said first air pressure.

9. The device according to claim 8 wherein said engine speed controller comprises:

(a) a relay-type speed governor having an input speed selector lever, said governor responsive to the engine speed;

(b) a pressure actuated piston responsive to air pressure for actuating the input speed selector lever of said governor; and (c) a selector valve responsive to the time delay control valve, for selecting and applying (i) said first air pressure to said piston when the engine is under normal loading conditions, and (ii) said second air pressure to said piston during the scan interval time to thereby reduce the fuel consumption of the engine under heavy loading.

10. The device according to claim 2 wherein the time interval generator comprises:

(a) an accumulator for storing a volume of pressurized air;

(b) a check valve connected to said accumulator;

(c) a throttle needle valve connected for throttling pressurized air into the atmosphere; and (d) a first control valve operatively associated with said check valve, said needle valve and said accumulator, said check valve and said first control valve cooperating in response to the start scan signal to apply the pressurized air in said accumulator to said needle valve to generate the scan interval time.

11. The device according to claim 10 wherein the load sensing means comprises:

(a) a cam actuated stress limit valve, for generating a start scan signal when the fuel supply means has reached a predetermined rate of fuel supply;

(b) a cam operatively associated with the fuel control signal, for actuating said stress limit valve; and (c) a second control valve operatively associated with said stress limit valve and said accumulator, said second control valve responsive to the start scan signal for activating said time interval generator.

12. The device according to claim 11 wherein the engine speed controller comprises:

(a) a centrifugal governor responsive to the engine speed, for generating the fuel control signal;

(b) a set of linkages operatively associated with said governor and said fuel supply means, for applying the fuel control signal to said fuel supply means;

(c) a piston servomotor movable connected with said set of linkages and responsive to the pressurized air from said accumulator, said linkages and said servomotor cooperating to reduce the fuel supply rate to the engine to a predetermined rate during the scan interval time.

13. The device according to claim 11 wherein the engine speed controller comprises:

(a) a centrifugal governor responsive to the engine speed, for generating the fuel control signal;

(b) a set of linkages operatively associated with said governor and said fuel supply means, for applying the fuel control signal to said fuel supply means; and (c) a piston servomotor operatively associated with said set of linkages and responsive to the pressurized air from said accumulator, said linkages and said servomotor cooperating to reduce the fuel supply rate to the engine to a predetermined rate during the scan interval time.

14. A method of controlling the speed of a marine diesel engine during periods of heavy loading condition to reduce the stress and fuel consumption to the engine, the method comprising the steps of:

(a) selecting a normal engine speed to be regulated during periods when the loading condition on the engine is less than a predetermined level;

(b) selecting a lower engine speed from the normal engine speed to be regulated during periods when the loading condition on the engine is greater than the predetermined level;

(c) sensing the loading condition on the engine;

(d) regulating the engine speed to the normal engine speed if the loading condition is less than the predetermined level;

(e) generating a predetermined scan interval time when the loading condition on the engine is greater than the predetermined level and having a duration until which the engine speed is regulated to the lower engine speed; and (f) repeating steps (c)–(f) at the completion of each scan interval time to enable the engine to run at a lower regulated engine speed than the normal speed throughout periods of heavy loading conditions, and to run at the normal speed when normal loading is present.

15. The method of claim 14 wherein the step of sensing the loading condition on the engine comprises the steps of:

(a) monitoring the position of the fuel control linkage to the engine fuel pumps; and (b) actuating a stress limit switch when the linkage reaches a predetermined position.

* * * * *